US005527124A

United States Patent [19]

Kolaric

[11] Patent Number: 5,527,124

[45] Date of Patent: Jun. 18, 1996

[54] SHAPED PEN

[76] Inventor: Marjan Kolaric, 109 Bidewell Avenue, North York, Ontario, Canada, M3H 1K1

[21] Appl. No.: 358,048

[22] Filed: Dec. 16, 1994

Related U.S. Application Data

[63] Continuation of Ser. No. 937,891, filed as PCT/CA91/00126, Apr. 16, 1991 published as WO91/16210 Oct. 31, 1991, abandoned.

[30] Foreign Application Priority Data

Apr. 17, 1990 [CA] Canada ..... 2014738

[51] Int. Cl.[6] ..... B43K 7/00; B43K 7/12

[52] U.S. Cl. ..... 401/6; 401/109; 401/209

[58] Field of Search ..... 401/214, 112, 401/6, 209, 230, 109; 15/435, 443, 437; D19/41, 43, 45, 47, 51, 55

[56] References Cited

U.S. PATENT DOCUMENTS

| | | | |
|---|---|---|---|
| D. 7,205 | 2/1874 | Worthington | D19/55 |
| D. 168,227 | 11/1952 | Kather . | |
| 655,731 | 8/1900 | Pierce | 401/230 |
| 849,513 | 4/1907 | Sturm | 401/6 X |
| 1,209,602 | 12/1916 | Mackenzie | 15/443 |
| 1,516,865 | 11/1924 | Muller . | |
| 1,747,167 | 2/1930 | Hill | 15/443 |
| 3,106,190 | 10/1963 | Fehling et al. . | |
| 3,225,745 | 12/1965 | Hechtle | 401/112 |
| 3,338,217 | 8/1967 | Harrison . | |
| 3,352,621 | 11/1967 | Fehling et al. . | |
| 4,269,529 | 5/1981 | McCollough . | |
| 4,679,954 | 7/1987 | Ambasz . | |
| 4,729,686 | 3/1988 | Ambasz . | |

FOREIGN PATENT DOCUMENTS

| | | | |
|---|---|---|---|
| 314960 | 5/1989 | European Pat. Off. | 401/209 |
| 367767 | 7/1906 | France . | |
| 518149 | 10/1919 | France . | |
| 2488551 | 2/1982 | France . | |
| 2553716 | 4/1985 | France | 401/6 |
| 30988 | 9/1884 | Germany | 15/443 |
| 294775 | 9/1915 | Germany | 15/443 |
| 674641 | 4/1939 | Germany . | |
| 902352 | 1/1954 | Germany . | |
| 900077247 | 4/1990 | Germany . | |
| 95264 | 10/1959 | Norway | 401/209 |
| 377680 | 6/1964 | Switzerland | 401/6 |
| 1202902 | 1/1986 | U.S.S.R. | 401/209 |
| 24610 | 11/1906 | United Kingdom | 15/443 |
| 979882 | 12/1963 | United Kingdom . | |

*Primary Examiner*—Steven A. Bratlie
*Attorney, Agent, or Firm*—Bereskin & Parr

[57] ABSTRACT

A pen of the type having a tubular housing with an aperture at one end thereof, a long tubular flexible ink reservoir dimensioned to fit within the housing, a writing tip mated to the ink reservoir and dimensioned to fit through the housing aperture, the improvement comprising a shaping of a lower section of the housing adjacent the apertured end thereof to reposition the writing tip relative to the longitudinal axis of an upper straight section of the housing, the shaping taking the form of a first portion which extends away from the longitudinal axis at a first angle and having a first length and a second portion contiguous with the first portion having a second length and extending back towards the longitudinal axis at a second angle relative to the first portion, the first and second lengths and the first and second angles being selected to position the writing tip at a preselected distance from the longitudinal axis. The shape of the lower section of the pen housing positions the writing tip at a steeper than usual angle to the surface of the paper while still allowing the user to maintain a comfortable grip upon the pen. In use the writing tip is angled towards the body-center of the user.

24 Claims, 3 Drawing Sheets

SHAPED PEN

This application is a continuation of Ser. No. 07/937,891, filed as PCT/CA91/00126, Apr. 16, 1991 published as WO91/16210 Oct. 31, 1991, now abandonded.

BACKGROUND OF THE INVENTION

The present invention relates to writing pens, and more particularly, to ball-point pens.

Pens come in a variety of shapes, sizes and types. There are felt tip pens, ball-point pens and fountain pens, all of which employ an ink reservoir mated to a writing tip of some sort and a body or housing for containing the writing tip and reservoir. For ball-point pens, the writing tip includes a ball contained in a metallic or plastic tube to form a ball-point. In use, the ball-point is rubbed against the surface of the paper and ink flowing from the reservoir to the ball-point is neatly deposited on the surface of the paper.

In order to maximize the free flow of ink onto paper, the body of the pen should be held so that the ball point is held as close to a vertical position from the surface of the paper as possible. If the ball-point is not held at such a steep angle, the ball-point lays down less ink on the paper.

Traditionally, pens have had straight tubular housings or bodies for containing the ink reservoir, which have an apertured writing end through which the writing tip projects in order to make contact with the paper. The straight tubular nature of traditional pen bodies is adequate for retaining the writing tip and ink reservoir but does not maximize the comfortable use of the pen.

In the past, attempts were made to improve the comfortable use of pens by modifying the housing with ridges or bulges located near the writing tip in order to better conform the housing of the pen to the grip of the user. Other attempts included the use of customized or modified writing tips in order to improve the position of the writing tip in relation to the grip of the user. H. R. Fehling et al., U.S. Pat. No. 3,106,190 discloses a ball-point pen having a ball held within an angled metal tube. This angled tube permits the ball-point to be held at the axis of the housing and at an angle closer to the verticle when the body of the pen is held in a comfortable writing position. Although a custom writing unit having a angled ball-point makes for better contact of ball-point with paper, the comfortable grip of the Fehling pen as with previous pens is limited by the straight stick-like shape of the body.

SUMMARY OF THE INVENTION

The present invention overcomes at least some of the limitations of the prior art by providing a pen having a tubular housing with an aperture at one end thereof, a long tubular flexible reservoir dimensioned to fit within the housing, a writing tip mated to the ink reservoir and dimensioned to fit through the housing aperture, wherein a lower section of the housing adjacent the apertured end is shaped to reposition the writing tip relative to the longitudinal axis of an upper substantially straight section of the housing. The shaping of the lower section takes the form of a first portion extending away from the longitudinal axis at a first angle and having a first pre-selected length and a second portion contiguous with the first portion having a second pre-selected length and extending back towards the longitudinal axis at a second angle relative to the first portion. The first and second pre-seleted lengths and the first and second angles are selected to position the writing tip at a pre-selected distance from the longitudinal axis.

In an alternative embodiment of the invention, the first and second portions are not co-planar and the angle of the second portion is selected to further position the writing tip at a third angle relative to the longitudinal axis and to one side of the plane of the housing defined by the first portion and the upper straight section of the housing.

In another alternative embodiment, the subject invention is a shaped pen comprising (a) a tubular housing having a straight upper portion defining a longitudinal axis of the pen and a shaped lower trunk; and (b) an ink reservoir dimensioned to fit within the housing having a writing tip;

(c) wherein the shaped lower trunk comprises an upper trunk section coaxial with the generally straight upper portion, a middle trunk portion separated from the upper trunk portion by a thumb bend, and a lower trunk portion separated from the middle portion by a rest finger bend;

(d) wherein the shapes of the bends and lengths of the trunk portions are selected to position the writing tip at a pre-selected distance from and angle to the longitudinal axis of the straight upper portion.

Other features and advantages of the present invention will become apparent from the following detailed description, taken in conjunction with the accompanying drawings, which illustrate, by way of example, the principles of the invention.

DETAILED DESCRIPTION OF THE PREFERRED EMBODIMENTS

Figure 1:
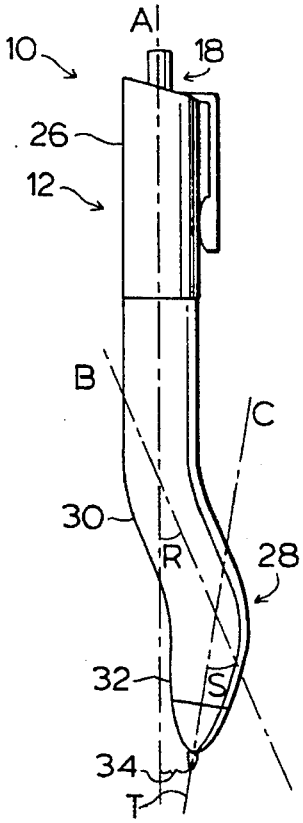
FIG. 1 is a side elevational view of a preferred embodiment of the invention showing the writing tip in the extended position.
Figure 2:
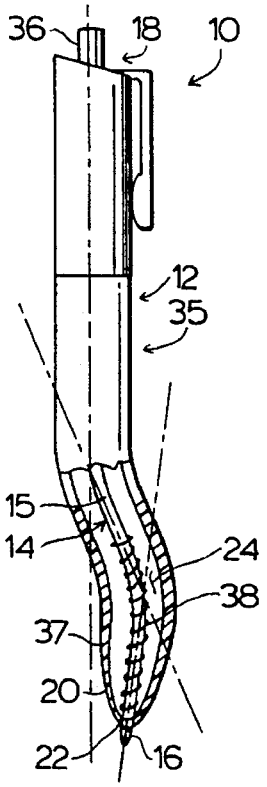
FIG. 2 is a side elevational view of the preferred embodiment, partly broken away in cross-section showing the ink reservoir and writing tip.

As can be seen from FIGS. 1 and 2, the pen shown generally as 10 comprises housing shown generally as 12, ink reservoir means shown generally as 14, writing tip shown generally as 16, and retracting means shown generally as 18.

With particular reference to FIG. 2, ink reservoir means 14 comprises a long tubular flexible ink reservoir 15 which is mated to writing tip 16. Ink reservoir 15 is a long flexible tube which is easily bent and deformed. In a preferred embodiment, writing tip 16 comprises a ball-point writing tip. Housing 12 is a long tube-like structure which tapers to writing end 20 having aperture 22. Housing 12 has chamber 24 and flexible ink reservoir 15 is adapted to fit within chamber 24. Writing tip 16 is configured to project through aperture 22.

Retracting means shown generally as 18 preferably comprises a push button 36 which engages reservoir 15 which in turn is biased by spring 58. When push button 36 1s depressed, reservoir 15 is pushed down through chamber 24 and writing tip 16 is extended out of aperture 22. A mechanism is provided within housing 12 for holding the reservoir in this position when push button 36 is released. Such mechanisms are well known in the art and may comprise a thrust tube/rotating sleeve arrangement, a ball and cam mechanism or some other mechanism. Which ever mechanism is used, when push button 36 is depressed and released again writing point 16 is drawn into chamber 24 by the recoil action of biasing spring 58. In order to facilitate the manufacture of these retractable pens, housing 12 is formed in two pieces which can be separated to permit the replacing of reservoir 15 when the ink contained therein is exhausted.

Referring to FIG. 1, housing 12 has an upper straight section 26 having a longitudinal axis shown by dotted line A. Lower section 28 of housing 12 adjacent apertured 22 is shaped to reposition writing tip 16 relative to longitudinal axles A. Lower shaped section 28 comprises first portion 30 and second portion 32. First portion 30 is continuous with upper straight section 26 and has an axis of its own defined by dotted line B. First portion 30 extends away from longitudinal axis A at first angle R. Second portion 32 is contiguous with first portion 30 and has also an axis of its own as shown by dotted line C. Second portion 32 extends back towards the longitudinal axis A at second angle S relative to axis B. First portion 30 and second portion 52 have a first pre-selected length and a second pre-selected length respectively. The first and second pre-selected lengths and angles R and S are selected to position writing tip 16 at pre-selected distance 34 from longitudinal axis A. In the preferred embodiment, axes A, B and C are co-planar, and angle S is selected so that axis C intersects axis A at third angle T resulting in writing tip 16 belong positioned at third angle T relative to longitudinal axis A.

Preferably, first angle R is between 15° to 30°, second angle S is between 10° to 30°, third angle T is between 5° to 15°, the lengths of first portion 30 and second portion 32 are between 2 to 4 cm and 1 to 3 cm respectively, the length of first portion 30 being greater than second portion 32. In the preferred embodiment, R is about 12°, S is about 20° and T is about 8°.

Figure 3:
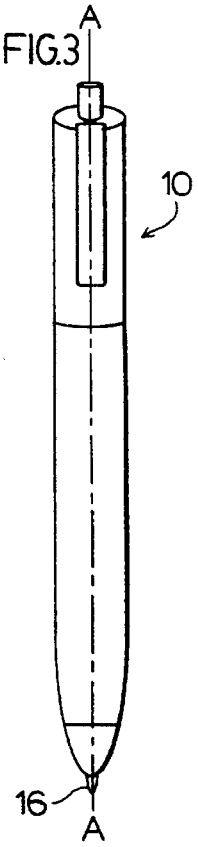
FIG. 3 is a front elevational view of the preferred embodiment, showing the writing tip in the extended position.
Figure 4:
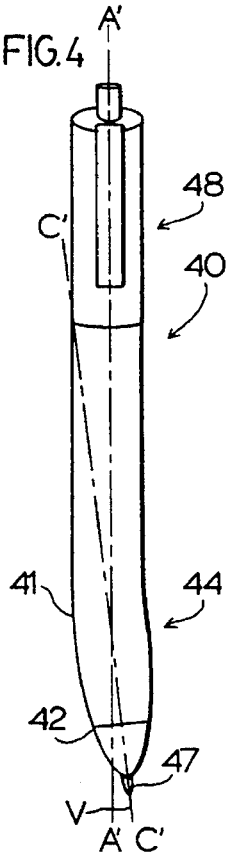
FIG. 4 is a front elevational view of an alternative embodiment showing the writing tip in the extended position.

As shown in FIG. 3, in a preferred embodiment, the bending of the lower section 28 of pen 10 takes place in a single plane, i.e. axes A, B and C are in a single plane. However, as shown in FIG. 4, in an alternative "right handed" embodiment, shown generally as 40, second portion 42 of lower housing section 44 is bent relative to first portion 41, resulting in axis $C^1$ of second portion 42 not belong in the plane defined by first portion 41 and upper straight housing section 48, such plane extending out of the page towards the reader. This bending of lower portion 42 results in writing tip 47 being positioned at angle V relative to the longitudinal axis $A^1$ at a distance of between about 1 to about 3 mm from the aforesaid plane. This alternative embodiment would be particularly useful as a writing implement for right handed people because it positions the writing tip towards the user and therefore the user can better see the writing tip and also results in less hand strain.

Figure 5:
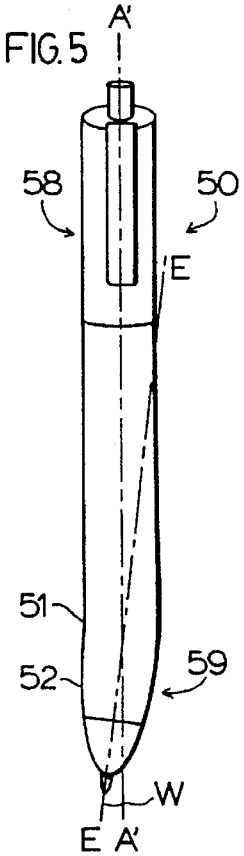
FIG. 5 is a front elevational view of another alternative embodiment showing the writing tip in the extended position.

Referring now to FIG. 5, in yet another alternative embodiment of the invention shown generally as 50, second portion 52 angles away from first portion 51 so that the axis of second portion 52 as shown by dotted line E intersects the plane defined by upper housing section 58 and first portion 51 of lower housing section 59 at angle W as shown in FIG. 5. This alternative embodiment would be particularly useful for people who are left handed.

In operation, the writing tip is first extended out of aperture 22 by depressing push button 36. Housing 14 is then grasped such that the thumb of operater rests against the point 35 near the junction of longitudinal portion 26 and first portion 30 and the third finger of the same hand rests against point 37 near writing end 20 of pen 10. Because writing tip 16 is positioned at pre-selected distance 34 from longitudinal axis A, and at third angle T relative to longitudinal axis A, pen 10 can be held comfortably in the hands, while at the same time positioning writing tip 16 at an angle which is steeper than the angle between the paper and the longitudinal axis of the upper part of the pen housing.

This positioning of writing tip 16 facilitates the free flow of ink, particularly if writing tip 16 comprises a ball-point. Furthermore, because of the shape of first portion 30 and second portion 32 of lower section 28, flexible ink reservoir 14 can slide freely within chamber 24, and therefore housing 12 could be utilized with standard flexible ink reservoirs having standard ball-points mated thereto. Also, because of the shape of housing 14 and the resulting orientation of the thumb and third finger when the pen is held in a writing position, the pen is more comfortable to hold. The lessening of the strain together with the generally more comfortable grip associated with pen 10 makes the use of pen 10 more comfortable in the hands of operators suffering from arthritis of the hands.

Although a retractable ball-point pen is illustrated in FIGS. 1 through 5, it is clear that the present invention may also comprise non-retractable pens having one piece or two piece bodies which use ball-point or felt tipped writing tips. In embodiments where no retracting means is provided, the writing tip is rigidly retained by the housing such that it rigidly extends out through the aperture. A cover or cap may be provided to cover over the writing tip when the pen is not in use.

Furthermore, all of the angles and pre-selected lengths may be modified to better conform the shape of the lower section of the housing to children.

Figure 6:
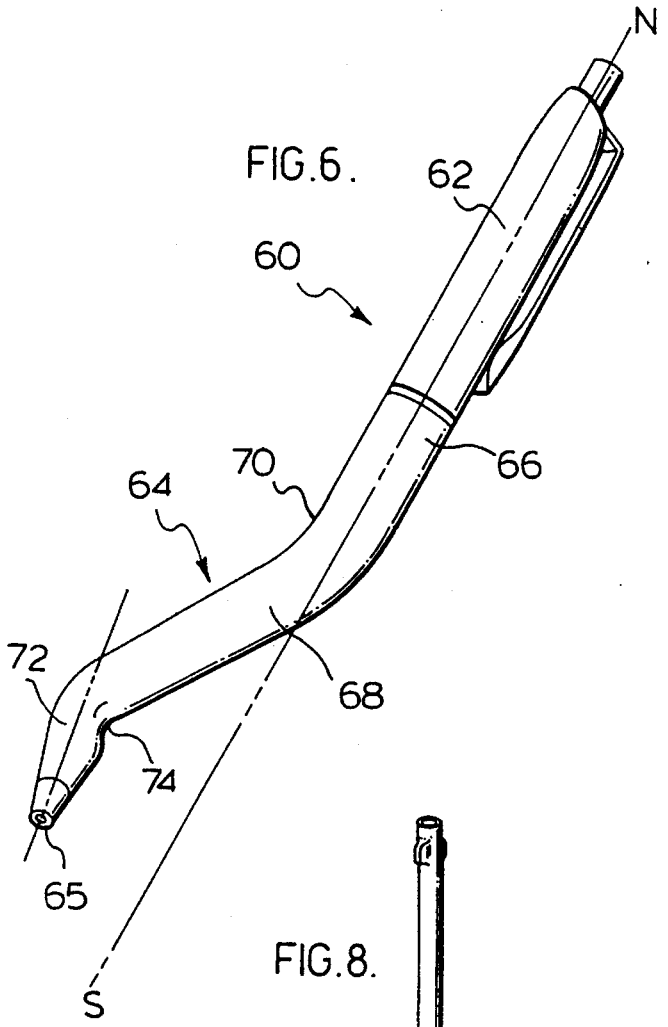
FIG. 6 is a perspective view of a further embodiment of the subject invention.

A further embodiment of the subject invention is illustrated in FIGS. 6–11 and described below. Referring now to FIG. 6, Pen 60 is a retractible ball point pen having a housing comprising cap 62 and a bent or shaped barrel or trunk 64 having an aperture at its tip 65.

Trunk 64 comprises a generally straight upper trunk section 66 coaxial with cap 62, a middle trunk section 68 separated from upper trunk section 66 by thumb bend 70, and a generally cone shaped lower trunk section 72 separated from middle trunk section 68 by rest finger bend 74. Trunk 64 may be thought of as being shaped in the form of a shallow S. The angles of bend 70 and bend 74, and the lengths of trunk sectlons 66, 68 and 70, can be varied to cult the needs of individual users or classes of users.

Thumb rest bend 70 results in raising the tip 65 of pen 60 above the north-south longitudinal axis of the pen, shown by dotted line N-S. Rest finger bend 74 re-directs tip 65 back towards longtudinal axis N-S, at an angle to a horizontal writing surface which is preferably greater than the angle assumed by longitudinal axis N-S when pen 60 is gripped in writing position. This allows the tip 65 to contact the writing surface at an angle close to the ideal 90° degree angle, when the writer assumes a normal hand posture in gripplng pen 60. Thumb bend 70 provides balance to pen 60, and thus tends to prevent pen 60 from flipping over durlng use. Thumb bend 70 also provides a contoured surface enabling pen 60 to be grasped comfortably. The result is an ergonomically designed pen, capable of being used with various writing positions.

Figure 7:
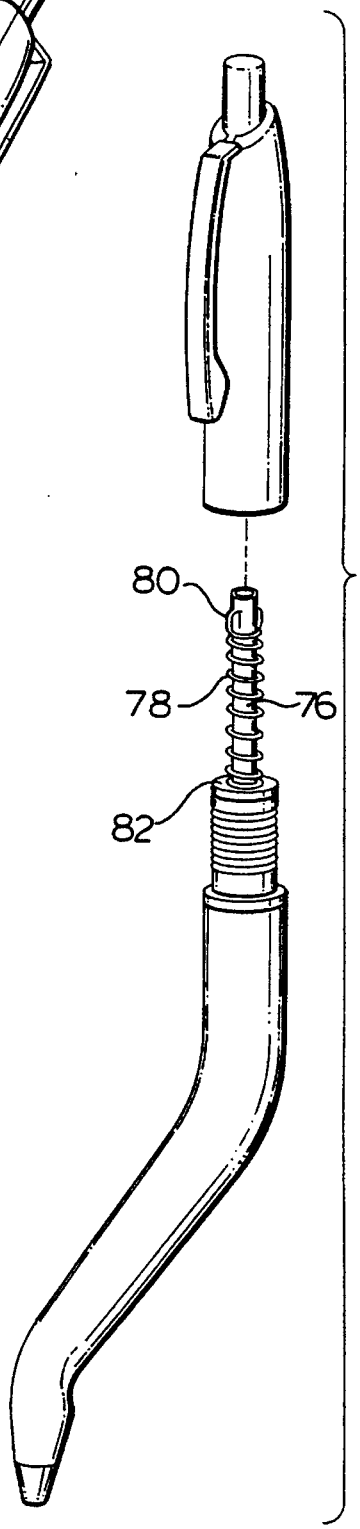
FIG. 7 is a perspective view of the further embodiment shown in FIG. 6, with its cap detached.
Figure 8:
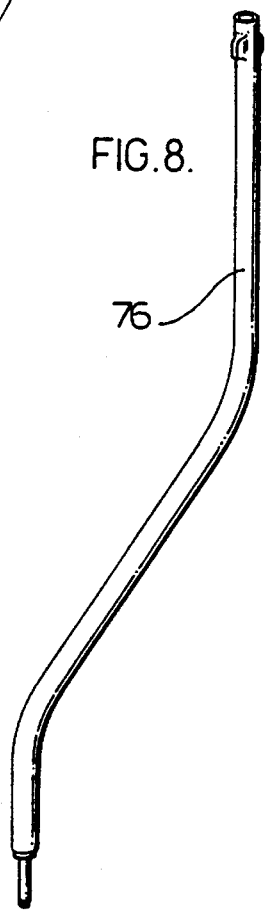
FIG. 8 is a perspective view of ink reservoir of the embodiment shown in FIG. 7.
Figure 9:
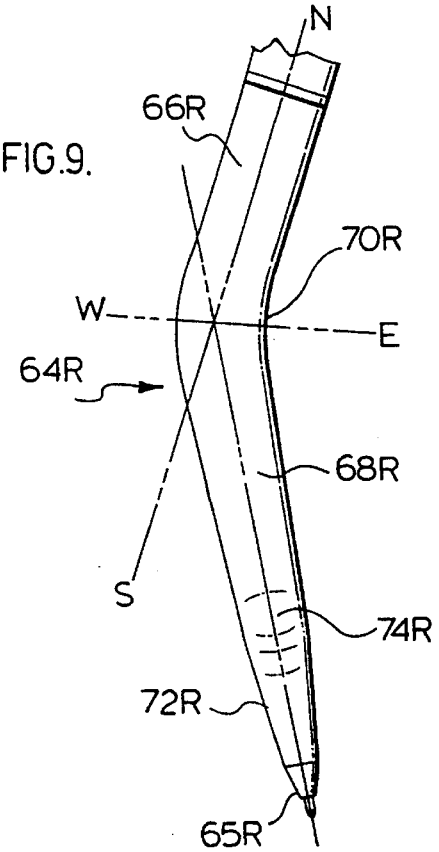
FIG. 9 is a top plan view of the trunk of a right-handed embodiment of the subject invention.

Referring now to FIGS. 7 and 8, pen 60 also comprises bent or curved ink reservoir 76 which is shaped generally similar to the shape of trunk 64. This shaping may be accomplished by heating up a straight plastic ink reservoir and melting it into its desired shape or by stressing it beyond its elastic limit so that ink reservoir does not assume its original shape in time. To enable ink reservoir 76 to be retracted and extended into trunk 64, spring 78 is installed around ink reservoir 76 near the top thereof between crimp 80 and washer 82.

As shown in FIG. 6, pen 60 is a "neutral" pen in the sense that bends 70, 74 are in the same plane containing the north-south axis of the pen. As a result, tip 65 of pen 60 is not angled to the left (east) or right (west).

However, east or west twists may be applied to either of north-south bends 70, 74 to better suit right or left handed users. Referring now to the topographic view of trunk 64R of a right-handed pen illustrated in FIG. 9, trunk 64R shaped for right-handed users, in that tip 65R is angled to the east or right of the longitudinal axis of trunk 64R as shown by dotted line N-S. In use, tip 65R of right-handed pen is angled towards the body-center of the user (or to the left, from the user's perspective). This "right-handed" embodiment is preferably formed by applying an east or right twist to thumb bend 70R (which extends out of the page), as opposed to twisting to the right rest finger bend 74R (which extends into the page). As a result, lower trunk portion 72R and middle trunk portion 68R remain generally co-planar, whereas upper trunk portion 66R and middle trunk portion 68R are no longer co-planar, due to the right-hand twist applied to thumb bend 70R during the forming of trunk 64R. Alternatively, a suitable mold can be designed to produce pen trunks having the desired right-hand laterally twisted S-bend shape.

Figure 10:
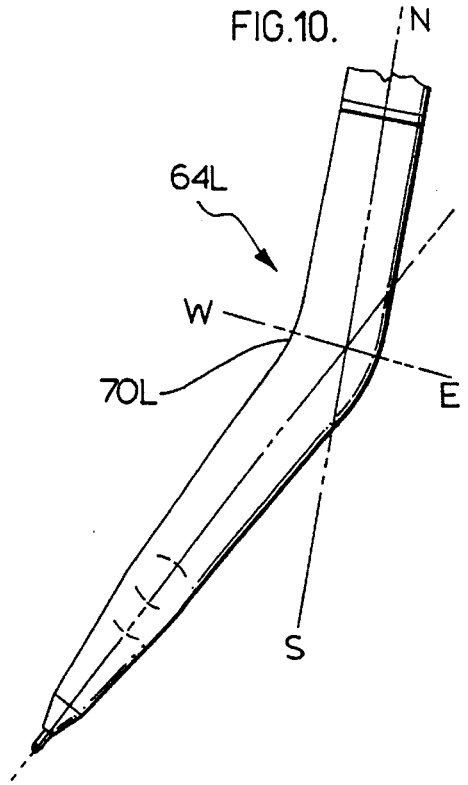
FIG. 10 is a top plan view of the trunk of a left-handed embodiment of the subject invention.

FIG. 10 illustrates a topographic view of trunk 64L of pen 60L. Trunk 64L is shaped for use by left-handers, by applying a left or west twist to the thumb rest bend 70L, either during reforming of a straight trunk, or by means of a suitable left twisted S-bend shaped mold.

Figure 11:
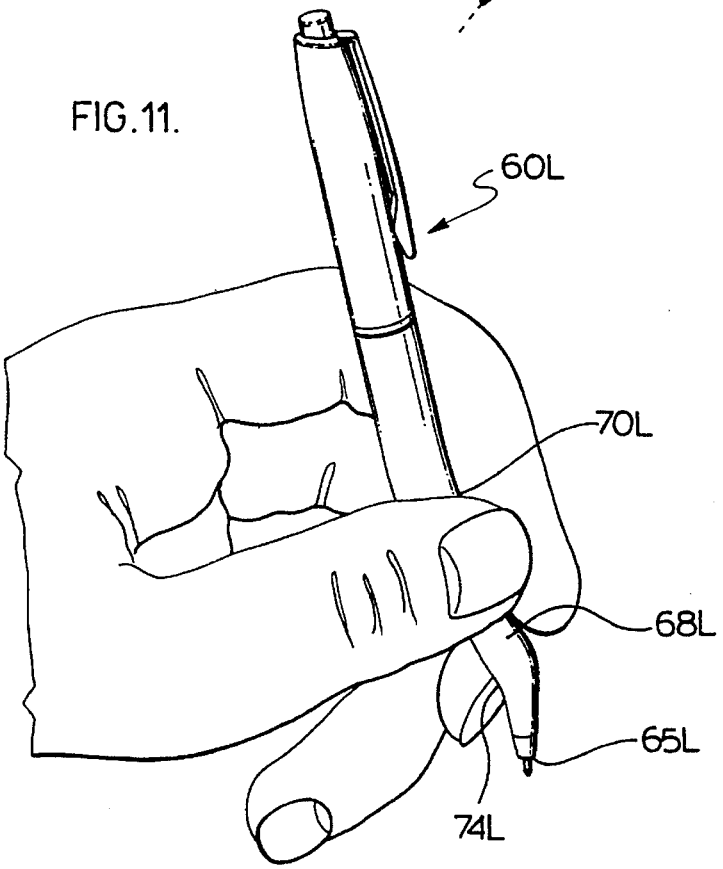
FIG. 11 is a perspective view showing the left-handed embodiment of the subject invention being held in writing position by a left-handed user.

FIG. 11 illustrates one way of holding the left-handed embodiment of the pen of the subject invention. Left-handed pen 60L is grasped by the user by placing his thumb against thumb bend 70L and resting the underside of middle trunk portion 68L against his rest finger. It will be noted that when held in this position, the tip 65L of pen 60L angled away from the body-center of the user and is positioned at nearly a 90° angle to the writing surface. An important feature of left-handed pen 60L is that re-angled tip 65L of pen 60L when gripped as shown i FIG. 11 now drags across the writing surface during writing operations, like the pulling action of chalk across a black board, as opposed to pushing the chalk (i.e. chiseling motion), which left-hand writers try to avoid by adopting the familiar cramped wrist posture.

The embodiment of the subject invention shown in FIGS. 6–11 has certain advantages over and above the advantages associated with the embodiments shown in FIGS. 1–5. The repositioning of spring 78 from near the curved tip of the pen to the straight upper section of the pen covered by cap 62 enables ink reservoir 76 to slide more freely in trunk 64 during extension and retraction of ink reservoir 76. The shaping of ink reservoir 76 not only assists ink reservoir to slide freely in shaped trunk 64, but also reduces internal stresses which tend to cause trunk 64 to straighten out over time. Pens 60R and 60L can be made by re-forming a straight pen in a jig with less steps than in the case of the embodiments shown in FIGS. 1–5.

The invention has been described with reference to various preferred and alternative embodiments. However, it is clear that certain modifications and variations can be made to the above embodiments without departing from the invention and such modifications and variations are intended to be included as falling within the scope of the following claims.

I claim:

1. A shaped pen, shaped to provide a comfortable writing position for a user having a pen hand with a thumb, index finger and rest finger, comprising a tubular housing including a straight upper housing portion defining a longitudinal axis of the pen and a contiguous user grippable shaped lower housing portion shaped in the form of a shallow "s" having an aperture, and an ink reservoir dimensioned to fit within the housing having a writing tip dimensioned to fit through the aperture, wherein the shaped lower housing portion comprises a straight upper section coaxial with the straight upper housing portion, a contiguous straight middle section having an upper surface and a lower surface and a longitudinal axis inclined at a first angle to the upper section by an upper bend located a first distance from the aperture, and a contiguous straight lower section having a longitudinal axis inclined at a second angle to the middle section by a lower bend located at a second distance from the aperture, wherein the first and second angles are selected to space the writing tip above the longitudinal axis of the pen, when the pen is gripped by a user in writing position, wherein the first and second distances are selected to enable the user, when gripping the pen in writing positions, to place his thumb on the upper surface of the middle section and to rest the lower surface of the middle section on his rest finger.

2. The shaped pen defined in claim 1, wherein the longitudinal axis of the middle section, the longitudinal axis of the lower section, and the longitudinal axis of the pen are co-planar.

3. The shaped pen defined in claim 1, wherein the longitudinal axis of the middle section and the longitudinal axis of the pen define a plane, and wherein the longitudinal axis of the lower section intersects said plane.

4. The shaped pen defined in claim 1, wherein the longitudinal axis of the lower section and the longitudinal axis of the middle section define a plane, and wherein the longitudinal axis of the pen intersects said plane.

5. The shaped pen defined in claim 1, adapted for use by right-handed users, wherein the longitudinal axis of the lower section intersects a plane defined by the longitudinal axis of the pen and the longitudinal axis of the middle section at such an angle that when the user grips the pen in a writing position, the lower section is inclined to the left towards the body center of the user.

6. The shaped pen defined in claim 1, adapted for use by left-handed users, wherein the longitudinal axis of the lower section intersects a plane defined by the longitudinal axis of the pen and the longitudinal axis of the middle section at such an angle that when the user grips the pen in a writing position, the lower section is inclined to the right towards the body center of the user.

7. The shaped pen defined in claim 1, wherein the writing tip is a ball-point, and the straight upper housing portion comprises a thread cap, and the upper section of the shaped lower housing portion is provided with threads which mate with the threaded cap.

8. The shaped pen defined in claim 7, further comprising tip retracting means for selectively retracting the writing tip into the housing.

9. The shaped pen defined in claim 8, wherein the retracting means is mounted in the straight upper housing portion.

10. The shaped pen defined in claim 9, wherein the retracting means comprises a spring mounted coaxially on the ink reservoir between a first stop rigidly coupled to the reservoir and a second stop coupled to the upper section of the lower housing portion.

11. The shaped pen defined in claim 10, wherein the first stop comprises a crimp near the top of the reservoir, and the second stop comprises a washer slideably received on a portion of the ink reservoir and resting against the top edge of the upper section of the lower housing portion.

12. The shaped pen defined in claim 1, wherein the shaped lower housing portion is formed by bending a lower part of a conventional straight ball-point pen housing.

13. The shaped pen defined in claim 1, wherein the shaped lower housing portion has a circular cross-section of gradually decreasing diameter.

14. The shaped pen defined in claim 1, wherein the first angle falls within the range of about 15° to 30°.

15. The shaped pen defined in claim 11, wherein the second angle falls within the range of about 10° to 30°.

16. The shaped pen defined in claim 15, wherein the first angle and second angle are selected to position the writing tip at an angle to the longitudinal axis of the pen.

17. The shaped pen defined in claim 1, wherein the writing tip is spaced about 3 mm to 7 mm above the longitudinal axis of the pen.

18. A left-handed pen shaped for use by left-handed users, comprising a tubular housing having an aperture at one end thereof, a long flexible ink reservoir dimensioned to fit within the housing, a ball-point writing tip mated to the ink reservoir and dimensioned to fit through the aperture, the housing comprising a straight upper housing piece having a longitudinal axis threaded onto a shaped lower piece, and tip retracting means for selectively retracting the tip into the housing, the retracting means including a crimp near the top of the reservoir, a washer slideably received on a portion of the reservoir extending above the lower housing piece and a spring mounted co-axially on the reservoir between the crimp and the washer, wherein the shaped lower piece comprises a substantially straight upper section coaxial with upper housing piece, and a contiguous shaped lower section extending to the aperture, the shaped lower section comprising a neck portion connected to the upper section by an upper bend extending away from the longitudinal axis at a first angle, and a tip portion connected to the neck portion by a lower bend extending back towards the longitudinal axis at a second angle, the first and second angles being selected to position the writing tip at a pre-selected distance above the longitudinal axis when the pen is in use, wherein one of the bends is also angled to the right so that in use the writing tip is angled to the right towards the body-center of the left-handed user.

19. The pen defined in claim 18, wherein the lower bend is angled to the right.

20. The pend defined in claim 18, wherein the upper bend is angled to the right.

21. A right-handed pen shaped for use by right-handed users, comprising a tubular housing having an aperture at one end thereof, a long flexible ink reservoir dimensioned to fit within the housing, a ball-point writing tip mated to the ink reservoir and dimensioned to fit through the aperture, the housing comprising a straight upper housing piece having a longitudinal axis threaded onto a shaped lower piece, and tip retracting means for selectively retracting the tip into the housing, the retracting means including a crimp near the top of the reservoir, a washer slideably received on a portion of the reservoir extending above the lower housing piece and a spring mounted co-axially on the reservoir between the crimp and the washer, wherein the shaped lower piece comprises a substantially straight upper section coaxial with upper housing piece, and a contiguous shaped lower section extending to the aperture, the shaped lower section comprising a neck portion connected to the upper section by an upper bend extending away from the longitudinal axis at a first angle, and a tip portion connected to the neck portion by a lower bend extending back towards the longitudinal axis at a second angle, the first and second angles being selected to position the writing tip at a pre-selected distance above the longitudinal axis when the pen is in use, wherein one of the bends is also angled to the left so that in use the writing tip is angled to the left towards the body-center of the right-handed user.

22. The pen defined in claim 21, wherein the lower bend is angled to the left.

23. The pen defined in claim 21, wherein the upper bend is angled to the left.

24. A shaped pen, comprising a tubular housing having an aperture at one end thereof, a long flexible ink reservoir dimensioned to fit within the housing, a ball-point writing tip mated to the ink reservoir and dimensioned to fit through the aperture, the housing comprising a straight upper housing piece having a longitudinal axis threaded onto a shaped lower piece, and tip retracting means for selectively retracting the tip into the housing, the retracting means including a crimp near the top of the reservoir, a washer slideably received on a portion of the reservoir extending above the lower housing piece and a spring mounted co-axially on the reservoir between the crimp and the washer, wherein the shaped lower piece comprises a substantially straight upper section coaxial with upper housing piece, and a contiguous shaped lower section extending to the aperture, the shaped lower section comprising a neck portion connected to the upper section by an upper bend extending away from the longitudinal axis at a first angle, and a tip portion connected to the neck portion by a lower bend extending back towards the longitudinal axis at a second angle, the first and second angles being selected to position the writing tip at a pre-selected distance above the longitudinal axis when the pen is in use.

* * * * *